US007912408B2

(12) United States Patent
Iwata et al.

(10) Patent No.: US 7,912,408 B2
(45) Date of Patent: Mar. 22, 2011

(54) IMAGE FORMING APPARATUS, PROCESS CARTRIDGE, AND DEVELOPMENT DEVICE

(75) Inventors: Nobuo Iwata, Sagamihara (JP); Junichi Matsumoto, Yokohama (JP); Tomoyuki Ichikawa, Kawasaki (JP); Natsumi Katoh, Atsugi (JP)

(73) Assignee: Ricoh Company Limited, Tokyo (JP)

( * ) Notice: Subject to any disclaimer, the term of this patent is extended or adjusted under 35 U.S.C. 154(b) by 294 days.

(21) Appl. No.: 12/048,705

(22) Filed: Mar. 14, 2008

(65) Prior Publication Data

US 2008/0226349 A1 Sep. 18, 2008

(30) Foreign Application Priority Data

Mar. 16, 2007 (JP) ..... 2007-069292

(51) Int. Cl.
*G03G 15/10* (2006.01)
*G03G 15/08* (2006.01)

(52) U.S. Cl. ..... 399/239; 399/254

(58) Field of Classification Search ..... 399/254, 399/255, 256, 258, 259, 260, 262, 263, 267, 399/269, 279, 272, 281, 239
See application file for complete search history.

(56) References Cited

U.S. PATENT DOCUMENTS

| | | | | |
|---|---|---|---|---|
| 7,426,360 | B2 * | 9/2008 | Arimoto et al. | 399/254 |
| 2006/0008281 | A1 | 1/2006 | Matsumoto et al. | |
| 2006/0140679 | A1 | 6/2006 | Iwata et al. | |
| 2006/0204283 | A1 * | 9/2006 | Yasuda | 399/254 |
| 2007/0053723 | A1 | 3/2007 | Iwata et al. | |
| 2007/0154242 | A1 | 7/2007 | Matsumoto et al. | |
| 2007/0166079 | A1 | 7/2007 | Ichikawa et al. | |
| 2007/0264053 | A1 | 11/2007 | Iwata et al. | |
| 2007/0274740 | A1 | 11/2007 | Katoh et al. | |

FOREIGN PATENT DOCUMENTS

| | | |
|---|---|---|
| JP | 2939099 | 6/1999 |
| JP | 11-288154 | 10/1999 |
| JP | 2005-173543 | 6/2005 |
| JP | 2005-215118 | 8/2005 |
| JP | 2006-163292 | 6/2006 |

* cited by examiner

*Primary Examiner* — David P Porta
*Assistant Examiner* — Faye Boosalis
(74) *Attorney, Agent, or Firm* — Oblon, Spivak, McClelland, Maier & Neustadt, L.L.P.

(57) ABSTRACT

An image forming apparatus includes a development device for supplying a developer containing toner and carrier to an electrostatic latent image carrying member for carrying thereon an electrostatic latent image, or a process cartridge for integrally storing the development device and the electrostatic latent image carrying member. The development device includes a conveyance path for charging and conveying the developer, and a developer carrying member for developing the electrostatic latent image into a toner image with the use of the developer conveyed through the conveyance path. The conveyance path includes a first conveyance member for receiving replenished toner and generating conveyance force for conveying the replenished toner and the developer in one direction, and a second conveyance member for generating conveyance force for conveying a portion of the developer conveyed by the first conveyance member in the opposite direction to the conveyance direction of the first conveyance member.

20 Claims, 5 Drawing Sheets

IMAGE FORMING APPARATUS, PROCESS CARTRIDGE, AND DEVELOPMENT DEVICE

CROSS-REFERENCE TO RELATED APPLICATION

This application claims priority to Japanese Patent Application No. 2007-069292, filed on Mar. 16, 2007, the entire contents of which are hereby incorporated by reference herein.

BACKGROUND OF THE INVENTION

1. Field of the Invention

The present invention relates to an image forming apparatus and a development device, and more specifically to a mechanism for stirring a developer.

2. Discussion of the Background Art

In an image forming apparatus such as a copier, a printer, and a facsimile machine, an electrostatic latent image formed on a photoconductor constituting a latent image carrying member is developed by a development device and transferred onto a sheet or the like, to produce a record output.

The image forming apparatus may be configured to include a single photoconductor for a single color or a plurality of photoconductors for forming images of a plurality of colors. The latter configuration is used to form a multicolor image, including a full-color image.

Types of developer used in development include a one-component developer, containing only magnetic or nonmagnetic toner, and a two-component developer containing a mixture of toner and carrier. The two-component developer contains toner and carrier for carrying the toner.

The toner is charged by a frictional charging action caused by stirring and mixing of the developer, and is electrostatically adsorbed to the electrostatic latent image formed on the photoconductor. Accordingly, proper stirring and mixing are vital to charging the toner adequately. The general structures typically used and the specific operations typically involved in achieving that end are described below.

In many cases, the development device is configured to include a stirring sleeve and a development sleeve. The stirring sleeve supplies the stirred and mixed developer to the development sleeve. The development sleeve supplies the developer to the electrostatic latent image on the photoconductor while magnetically forming upright spikes of the developer on a circumferential surface of the photoconductor. In some cases, each of the sleeves includes a screw auger.

The two sleeves are disposed opposite each other in a helical direction, and are configured to stir the developer while moving and circulating the developer in opposite directions with respect to an axial direction thereof.

As the toner contained in the developer is consumed, the image density is reduced. Thus, the toner needs to be replenished. In the replenishment of the toner, the toner may be poured from an upper portion or an end portion in the axial direction of the stirring sleeve. Usually, the stirring sleeve rotates while mostly buried in the developer. Meanwhile, the replenished toner drops onto the upper surface of the developer in which the stirring sleeve is buried, and thus tends to accumulate on the upper surface of the developer. As a result, adequate stirring and mixing action based on the rotation of the stirring sleeve is difficult to obtain.

In view of the above, various configurations for facilitating the charging of the replenished toner by facilitating the stirring and mixing thereof have been proposed. For example, in a configuration according to one background technique, a toner replenishing tank includes therein a screw member disposed in a longitudinal direction of the tank to rotate on the axis thereof or revolve around another object in the toner prior to the mixing of the toner into the developer, so that the toner is stirred and mixed, and thus charged, by a combination of the rotation and the revolution of the screw member.

Further, in a configuration according to another background technique, an auxiliary stirring member is provided in addition to an existing stirring sleeve to push the developer into spaces formed by a helical blade of the stirring sleeve when the replenished toner is stirred into the developer.

A main purpose of the stirring sleeve using the screw auger is to convey the developer along the helical direction. Therefore, in conveyance by the stirring sleeve, a pushing movement by the helical blade is used to stir the developer. Thus, even if the developer in contact with the helical blade receives the rotational force of the helical blade, the developer is stirred relatively little, since, as noted, the main action of the stirring sleeve is to push the developer in the conveyance direction with the helical blade. Consequently, the stirring sleeve does not sufficiently stir and mix the toner. If the stirring and mixing is insufficient, the frictional charging based on the stirring and mixing becomes unstable. As a result, inappropriately charged toner is scattered to stain and damage surrounding areas, and adheres to a non-image area on the photoconductor to cause scumming.

To prevent a reduction in the amount of charged toner in the developer, it is possible to increase the rotational speed of the screw auger to increase the probability of contact between the toner and the carrier in the developer. However, increasing the probability of contact in this way tends to remove a coating layer of the carrier. As a result, the charging performance of the carrier is degraded, accelerating deterioration of the developer.

SUMMARY OF THE INVENTION

This patent specification describes an image forming apparatus. In one example, an image forming apparatus includes either one of a development device for supplying a developer containing toner and carrier to an electrostatic latent image carrying member for carrying thereon an electrostatic latent image, and a process cartridge for integrally storing the electrostatic latent image carrying member and the development device. The development device includes a conveyance path for charging and conveying the developer, and a developer carrying member for developing the electrostatic latent image on the electrostatic latent image carrying member into a toner image with the use of the developer conveyed through the conveyance path. The conveyance path includes a first conveyance member for receiving replenished toner and generating conveyance force for conveying the replenished toner and the developer in one direction, and a second conveyance member for generating conveyance force for conveying a portion of the developer conveyed by the first conveyance member in the opposite direction to the conveyance direction of the first conveyance member.

This patent specification further describes a process cartridge. In one example, a process cartridge integrally stores an electrostatic latent image carrying member for carrying thereon an electrostatic latent image and a development device for supplying the electrostatic latent image carrying member with a developer containing toner and carrier. The development device includes a conveyance path for charging and conveying the developer, and a developer carrying member for developing the electrostatic latent image on the electrostatic latent image carrying member into a toner image with the use of the developer conveyed through the conveyance path. The conveyance path includes a first conveyance member for receiving replenished toner and generating conveyance force for conveying the replenished toner and the developer in one direction, and a second conveyance member for generating conveyance force for conveying a portion of the developer conveyed by the first conveyance member in the opposite direction to the conveyance direction of the first conveyance member.

This patent specification further describes a development device. In one example, a development device includes a conveyance path for charging and conveying a developer containing toner and carrier, and a developer carrying member for developing an electrostatic latent image formed on an electrostatic latent image carrying member into a toner image with the use of the developer conveyed through the conveyance path. The conveyance path includes a first conveyance member for receiving replenished toner and generating conveyance force for conveying the replenished toner and the developer in one direction, and a second conveyance member for generating conveyance force for conveying a portion of the developer conveyed by the first conveyance member in the opposite direction to the conveyance direction of the first conveyance member.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
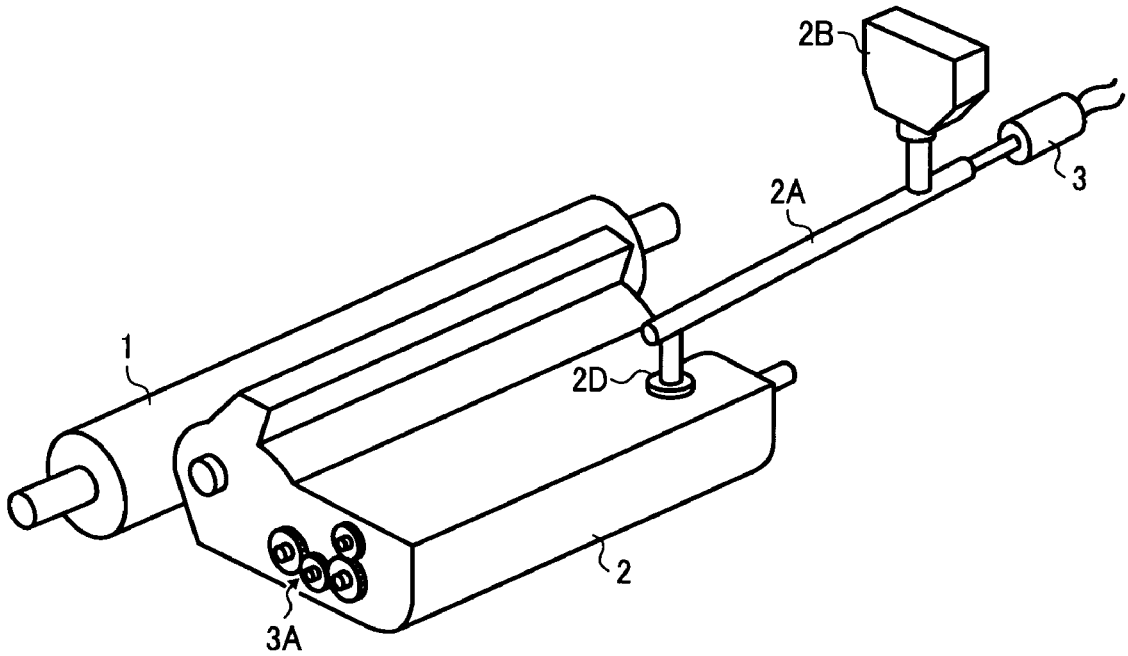
FIG. 1 is a perspective view illustrating a configuration of essential parts of an image forming apparatus applied with a development device according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIG. 1, description will be made of an embodiment of the present invention. FIG. 1 is a perspective view illustrating essential parts of an image forming apparatus including a development device according to an embodiment of the present invention. In FIG. 1, the image forming apparatus includes a photoconductor 1 constituting a latent image carrying member, and a development device 2 for performing image visualization processing of visualizing an electrostatic latent image formed on the photoconductor 1. As the other devices used in an image forming process, the image forming apparatus further includes a charging device, a transfer device, a cleaning device, and a fixing device, which are omitted in FIG. 1. The photoconductor 1 and the development device 2 illustrated in FIG. 1 and the charging device and the cleaning device (not illustrated) are integrally stored in a process cartridge (not illustrated).

The development device 2 includes a toner replenishing pipe 2A connected to the upper surface of a development tank thereof. The toner replenishing pipe 2A is replenished with toner from a toner replenishing tank 2B storing new toner.

As described later in FIG. 2, the development tank includes therein a development sleeve 4, a stirring sleeve 7, and a supply sleeve 6. The development sleeve 4 faces the photoconductor 1 to supply a developer thereto. The stirring sleeve 7 stirs and mixes the developer with the toner replenished from the toner replenishing tank 2B in a replenishing tank filled with the replenished toner. The supply sleeve 6 conveys to the development sleeve 4 the two-component developer containing carrier and the toner charged by frictional charging due to the stirring by the stirring sleeve 7. The sleeves can operate in conjunction with one another via gears 3A attached to rotary shafts supported by the development tank. The reference numeral 3 of FIG. 1 denotes a drive motor for driving a conveyance member provided in the toner replenishing pipe 2A.

Figure 2:
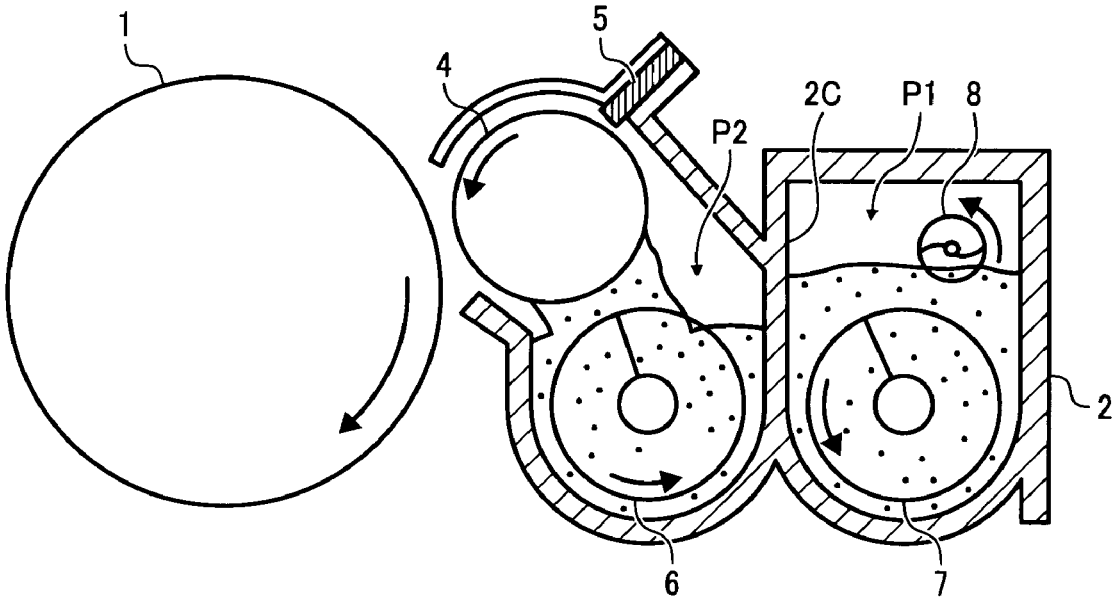
FIG. 2 is a schematic diagram illustrating an internal configuration of a development tank used in the development device according to the embodiment of the present invention.

FIG. 2 is a schematic diagram illustrating an internal configuration of the development device 2. In FIG. 2, the development tank includes an internal space divided by a dividing wall 2C. One of the divided spaces is used as the replenishing tank corresponding to a first conveyance path P1, and the other one of the divided spaces is used as a supply tank corresponding to a second conveyance path P2. The replenishing tank and the supply tank are herein referred to as the first conveyance path P1 and the second conveyance path P2, respectively, since the developer is conveyed in the tanks along the axial direction of the tanks by the later-described stirring sleeve 7 and supply sleeve 6 each formed by a helical member.

The supply tank includes the development sleeve 4, a doctor blade 5, and the supply sleeve 6. The development sleeve 4 faces the photoconductor 1, and constitutes a developer carrying member. The doctor blade 5 controls the layer thickness of the developer carried on the development sleeve 4. The supply sleeve 6 supplies the stirred and mixed developer to the development sleeve 4, and corresponds to a third conveyance member (hereinafter referred to as the third conveyance member 6).

The replenishing tank is provided on a ceiling surface thereof with a replenishing port 2D (see FIG. 1) communicating with the toner replenishing pipe 2A, and the stirring sleeve 7 formed by a helical member for stirring and mixing the developer and the replenished toner to charge the developer (hereinafter referred to as the first conveyance member 7).

In addition to the first conveyance member 7, the replenishing tank further includes, in the vicinity of the first conveyance member 7, an auxiliary stirring member 8 for generating conveyance force in the opposite direction to the conveyance direction of the first conveyance member 7 (hereinafter referred to as the second conveyance member 8). The second conveyance member 8 is formed by a helical member similarly to the first conveyance member 7. The first conveyance member 7 and the second conveyance member 8 provided in the replenishing tank are opposite to each other in the conveyance direction of the developer, and thus are opposite to each other in the helical direction. In the present embodiment, the second conveyance member 8 is formed to be smaller in diameter than the first conveyance member 7. Accordingly, the different types of conveyance members can be stored in a limited space of the replenishing tank.

Further, as understood from FIG. 2, a helical fin of the second conveyance member 8 is disposed to be in contact with the upper surface of the developer moving in the replenishing tank. Thus, when the toner poured into the replenishing tank is accumulated on the upper surface of the developer, the helical fin of the second conveyance member 8 comes in contact with the upper surface of the accumulated developer.

With the present embodiment thus configured, the toner replenished into the replenishing tank is poured onto the upper surface of the developer stirred and moved in the axial direction in the replenishing tank.

The first conveyance member 7 and the second conveyance member 8 are thus set to be opposite to each other in the conveyance direction of the developer. Therefore, a portion of the developer conveyed by the conveyance force of one of the first conveyance member 7 and the second conveyance member 8 is sheared by a portion of the developer conveyed by the conveyance force of the other conveyance member. Thus, each of the portions of the developer is partially drawn in the opposite direction to the previously set direction. As a result, in a region in which the developer has been drawn in the opposite direction to the previously set direction, the amount of developer which should have been moved in the previously set direction by the corresponding conveyance member is reduced. Accordingly, a portion of the developer easily breaks in a perpendicular direction to the conveyance direction, i.e., the lateral direction in FIG. 2 in the present example, and is easily pushed into the other portion of the developer by the second conveyance member 8.

In the broken portion of the developer, therefore, the toner poured onto the upper surface of the developer easily sinks into the developer, and is easily pushed into the developer by the second conveyance member 8. As a result, a portion of the replenished toner accumulated on the upper surface of the developer is moved in the axial direction without being stirred, along with the movement of the developer by the conveyance force of the first conveyance member 7 and the second conveyance member 8 generated by the rotation of the conveyance members. Meanwhile, another portion of the replenished toner enters into the developer from the broken portion of the developer to be stirred and mixed in the developer. Accordingly, the chance of contact between toner and the carrier is increased, and the charging efficiency of the developer containing the replenished toner can be increased.

The configuration of the first conveyance member 7 and the second conveyance member 8 is not limited to the above-described configuration in which the second conveyance member 8 is formed to be smaller in diameter than the first conveyance member 7. Thus, the second conveyance member 8 and the first conveyance member 7 may be configured as a second conveyance member 18 and a first conveyance member 17 having the same diameter, as illustrated in FIG. 3, or may be configured as a second conveyance member 28 forming an inner helical portion and a first conveyance member 27 forming an outer helical portion, which are supported by the same shaft, as illustrated in FIG. 4, with the two helical portion set to have the opposite helical directions.

Figure 3:
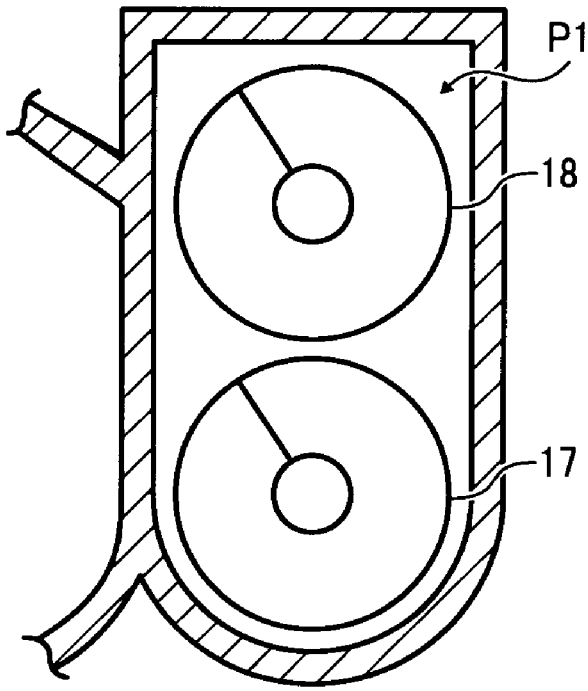
FIG. 3 is a diagram illustrating an example of configuration of first and second conveyance members disposed in a replenishing tank corresponding to a first conveyance path of the development device illustrated in FIG. 2.

The configuration illustrated in FIG. 3 only requires two conveyance members of the same shape set to have the opposite helical directions. Therefore, the number of components and the component management cost can be reduced.

Figure 4:
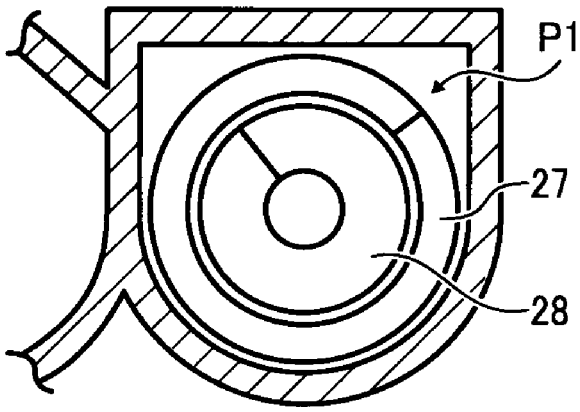
FIG. 4 is a schematic diagram illustrating a modified example of the configuration of the first and second conveyance members illustrated in FIG. 3.

In the configuration illustrated in FIG. 4, the outer helical portion is used as a stirring and mixing portion for circulating and conveying the developer, and the inner helical portion is used as the above-described auxiliary stirring member. With this configuration, the outer helical portion conveys the developer while securing a relatively large rotary torque required for the circulation and the conveyance, while the inner helical portion breaks a portion of the developer moving in the opposite direction to the conveyance direction of the outer helical portion to make the replenished toner easily sink into the developer.

Figure 5:
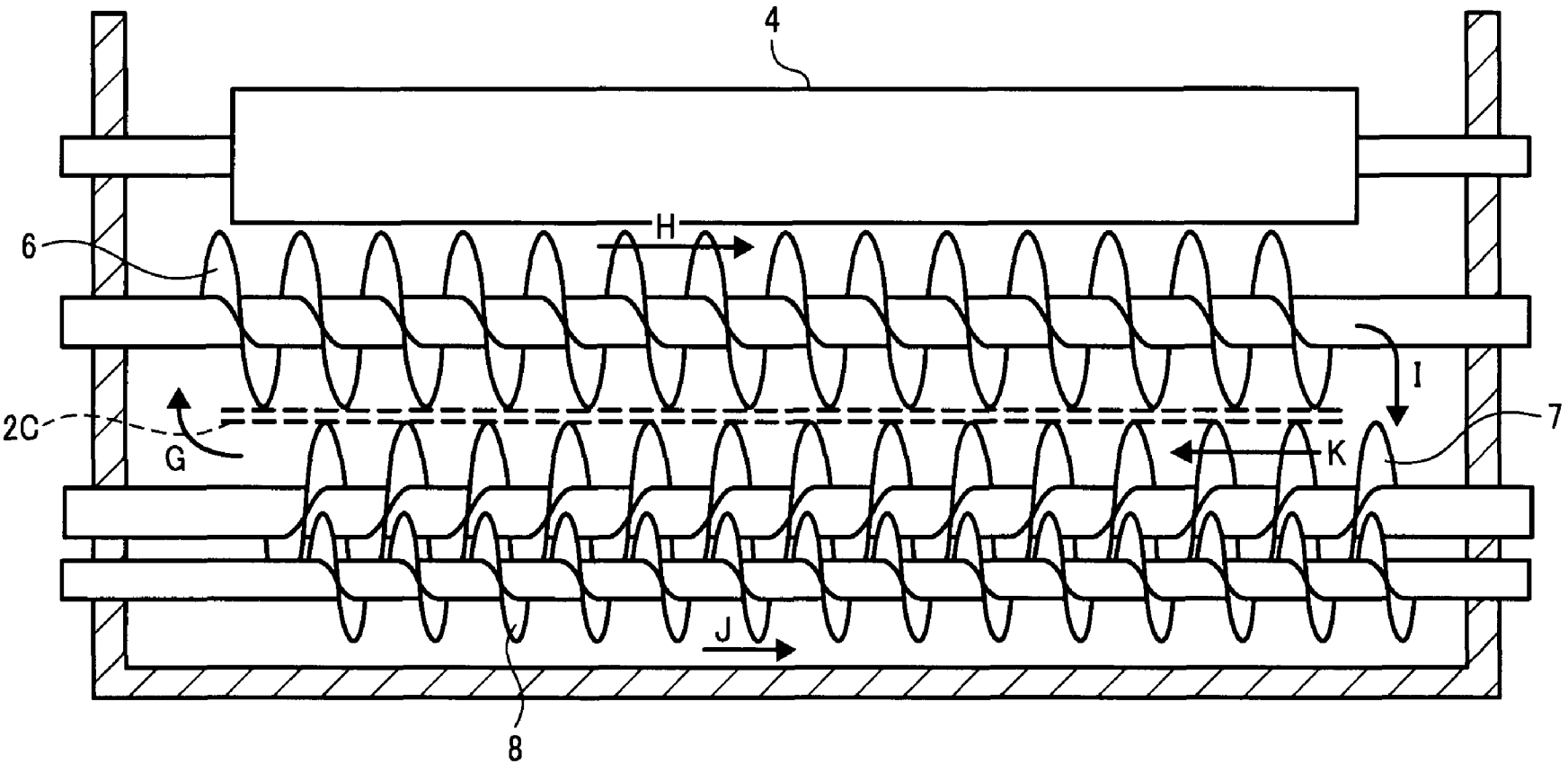
FIG. 5 is a front view illustrating a part of the development device illustrated in FIG. 2.

FIG. 5 illustrates a plan view of the development device 2 illustrated in FIG. 2. In FIG. 5, the first conveyance member 7 and the third conveyance member 6 convey the developer in the opposite directions in the development tank so that the developer moves toward both the first conveyance member 7 and the third conveyance member 6 over the dividing wall 2C. Thereby, the developer is circulated and conveyed. The third conveyance member 6 has a function of collecting remaining developer and moving the developer into the replenishing tank. In the replenishing tank, the collected developer is stirred and mixed, and the developer and the replenished toner are stirred and mixed. Then, the developer is again moved to the supply tank in which the third conveyance member 6 is located.

Meanwhile, the replenishing tank is provided with the first conveyance member 7 and the second conveyance member 8. The first conveyance member 7 and the second conveyance member 8 are opposite to each other in the conveyance direction of the developer. Thus, a portion of the developer breaks, and a portion of the new toner replenished and accumulated on the upper surface of the developer sinks into the developer to be stirred therein. In FIG. 5, the arrows G, H, I, J, and K indicate the conveyance directions of the developer.

Figure 6A:
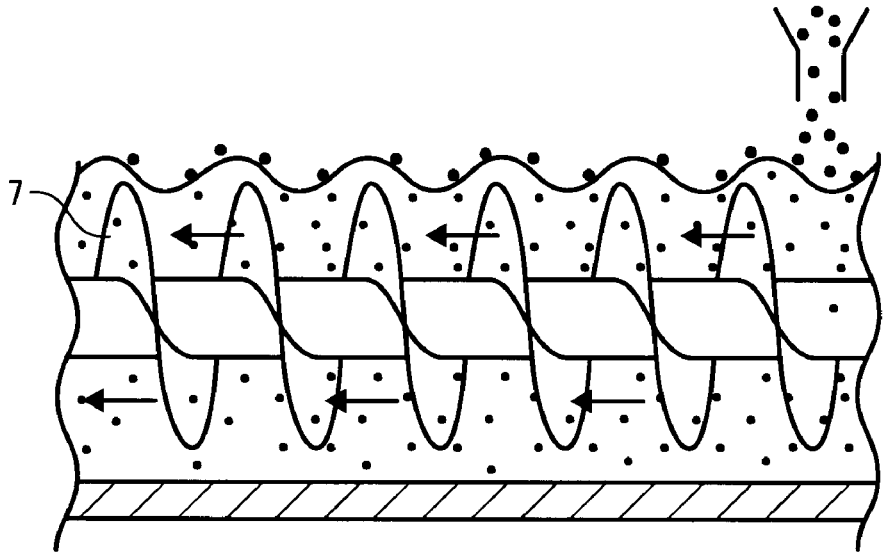
FIGS. 6A and 6B are schematic diagrams for explaining an action of the configuration illustrated in FIG. 2, as compared with a background example.
Figure 6B:
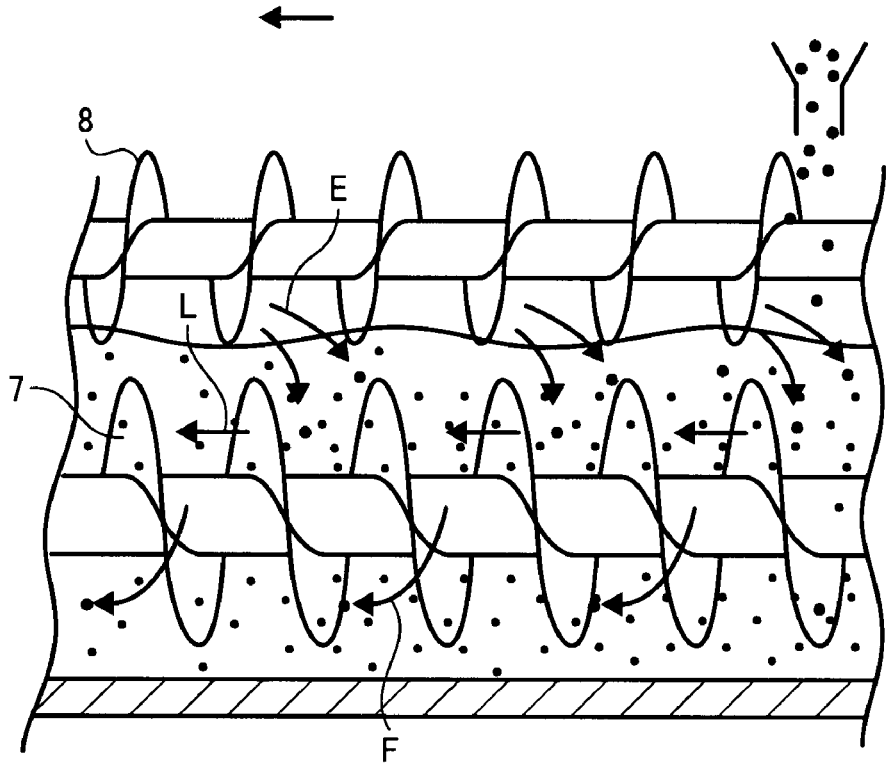

FIG. 6B is a front view illustrating a part of the development device 2 of the embodiment illustrated in FIG. 2. FIG. 6A illustrates a background example presented for comparison with the present embodiment.

In FIG. 6A, in which a replenishing tank corresponding to the first conveyance path P1 solely includes a stirring sleeve, the developer moves in the axial direction while making a helical movement, as indicated by the arrows in FIG. 6A. Accordingly, as described above, the replenished toner poured onto the upper surface of the developer is accumulated on the upper surface of the moving developer and moved without sinking into the developer.

Meanwhile, in the present embodiment, the first conveyance member 7 and the second conveyance member 8 are opposite to each other in the conveyance force. Therefore, a portion of the developer moving in one direction and a portion of the developer moving in the opposite direction easily break. Further, the second conveyance member 8 increases the chance of the toner to be pushed into the developer. In FIG. 6B, therefore, there are movement along the axial direction as indicated by the arrows L, and movement in the directions in which the toner is broken and pushed into the developer to sink into the developer as indicated by the arrows E and F. Accordingly, the toner sunk into the developer is stirred and mixed, and the amount of the charged toner in the developer is increased.

Figure 7:
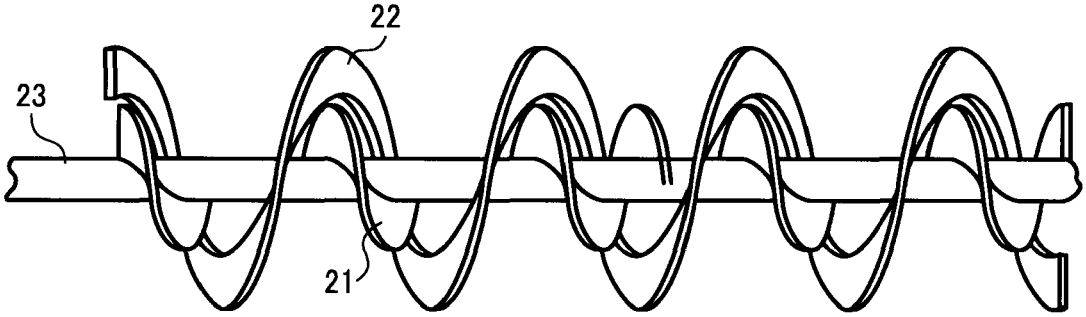
FIG. 7 is a front view illustrating a configuration of the first and second conveyance members illustrated in FIG. 4.

FIG. 7 is a front view illustrating a part of a development device including the first conveyance member 27 and the second conveyance member 28 of the configuration illustrated in FIG. 4. In FIG. 7, the reference numeral 23 denotes a shaft. The shaft 23 is fixedly wound with the inner helical portion (hereinafter referred to as the inner helical fin 21) of the second conveyance member 28. Further, the shaft 23 is provided with the outer helical portion (hereinafter referred to as the outer helical fin 22) of the first conveyance member 27 located outside the inner helical fin 21 and fixed to the shaft 23 at the opposite ends thereof. Furthermore, the inner helical fin 21 and the outer helical fin 22 are opposite to each other in the helical direction. That is, the inner helical fin 21 and the outer helical fin 22 are configured to convey the developer in the opposite directions when the shaft 23 is rotated.

Figure 8:
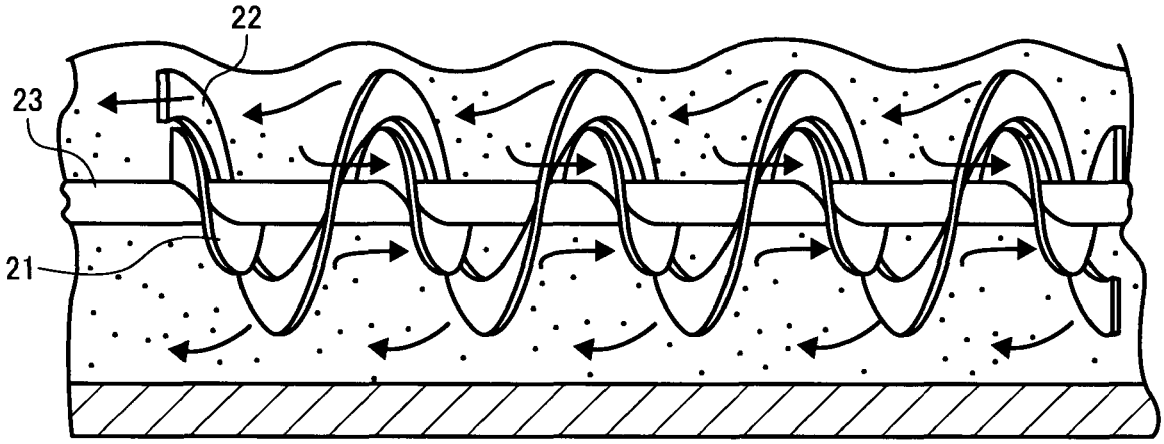
FIG. 8 is a schematic diagram for explaining a conveyance state of a developer by the first and second conveyance members illustrated in FIG. 7.

FIG. 8 illustrates a state in which the developer is conveyed by the inner helical fin 21 and the outer helical fin 22 illustrated in FIG. 7. In FIG. 8, as the shaft 23 is rotated, the developer is conveyed to the left side in the drawing by the outer helical fin 22. This conveyance constitutes a main conveyance. Meanwhile, in a portion of the developer located in a central area, the inner helical fin 21 causes a movement returning back to the right side in the drawing. Accordingly, a convective flow occurs in the conveyed developer. The convective flow and the above-described cause generate the action in which the toner replenished and accumulated on the upper part of the developer sinks into the developer to be mixed therein.

Another embodiment of the present invention will now be described. A characteristic of the present embodiment is in the conveyance force of the first conveyance member 7, the second conveyance member 8, and the third conveyance member 6. In the present embodiment, the relationship of the conveyance force of the conveyance members is set such that the conveyance force of the first conveyance member 7 is greater than the conveyance force of the third conveyance member 6, and that the conveyance force of the third conveyance member 6 is greater than the conveyance force of the second conveyance member 8.

The above-described setting is based on the following reason. Due to the provision of the oppositely directed conveyance member, the speed of conveyance by the existing conveyance member originally intended to circulate and convey the developer is reduced. Thus, there is a need to balance the amount of conveyance by the first and second conveyance members 7 and 8 with the amount of conveyance by the third conveyance member 6.

As a configuration for setting the above-described relationship of the conveyance force, the rotational speed or the helical pitch may be differentiated between the first and second conveyance members 7 and 8. Further, the second conveyance member 8 may be reduced in diameter, as described above, and also may be reduced in rotational speed.

With the above-described configuration, it is possible to balance the amount of conveyance by the third conveyance member 6 with the combined amount of conveyance by the first and second conveyance members 7 and 8, and thus to supply a proper amount of the developer and secure a proper amount of the charged toner.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape, are not limited the embodiments and thus may be preferably set. It is therefore to be understood that within the scope of the appended claims, the disclosure of this patent specification may be practiced otherwise than as specifically described herein.

The invention claimed is:

1. An image forming apparatus, comprising:

a development device for supplying a developer to an electrostatic latent image carrying member configured to carry thereon an electrostatic latent image, the developer including toner and carrier; and a process cartridge configured to incorporate the electrostatic latent image carrying member and the development device, wherein the development device includes:

a conveyance path for charging and conveying the developer, the conveyance path including an internal space divided by a dividing wall into at least a first area and a second area, and a developer carrying member, wherein the first area of the internal space is undivided and includes:

a first conveyance member for receiving replenished toner and generating conveyance force for conveying the replenished toner and the developer in a first conveyance direction, and a second conveyance member for generating conveyance force for conveying a portion of the developer conveyed by the first conveyance member in a direction opposite to the first conveyance direction of the first conveyance member, and wherein the developer carrying member is configured to develop the electrostatic latent image on the electrostatic latent image carrying member into a toner image using the developer conveyed through the conveyance path.

2. The development device as described in claim 1, wherein the second area of the internal space includes a third conveyance member facing the developer carrying member to convey the developer to the developer carrying member which conveys the toner to the electrostatic latent image carrying member, and wherein the conveyance force of the first conveyance member is greater than the conveyance force of the third conveyance member, and the conveyance force of the third conveyance member is greater than the conveyance force of the second conveyance member.

3. The development device as described in claim 1, wherein the second conveyance member constitutes a helical member disposed to be partially in contact with an upper surface of the developer in the first area of the internal space, into which the replenished toner is poured.

4. The development device according to claim 1, wherein the first area of the internal space is configured such that when filled with developer, the developer substantially buries the first conveyance member in the first area of the internal space, and the second conveyance member is disposed above the first conveyance member such that an outer edge of a helical fin of the second conveyance member passes through a surface level of the developer burying the first conveyance member to convey the developer in the opposite direction to the first conveyance direction.

5. A process cartridge, comprising:

an electrostatic latent image carrying member for carrying thereon an electrostatic latent image; and a development device for supplying the electrostatic latent image carrying member with a developer containing toner and carrier, the development device including:

a conveyance path for charging and conveying the developer, the conveyance path including an internal space divided by a dividing wall into at least a first area and a second area, and a developer carrying member, wherein the first area of the internal space is undivided and includes:

a first conveyance member for receiving replenished toner and generating conveyance force for conveying the replenished toner and the developer in a first conveyance direction, and a second conveyance member for generating conveyance force for conveying a portion of the developer conveyed by the first conveyance member in a direction opposite to the first conveyance direction of the first conveyance member, and wherein the developer carrying member is configured to develop the electrostatic latent image on the electrostatic latent image carrying member into a toner image using the developer conveyed through the conveyance path.

6. The development device as described in claim 5, wherein the second area of the internal space includes a third conveyance member facing the developer carrying member to convey the developer to the developer carrying member which conveys the toner to the electrostatic latent image carrying member, and wherein the conveyance force of the first conveyance member is greater than the conveyance force of the third conveyance member, and the conveyance force of the third conveyance member is greater than the conveyance force of the second conveyance member.

7. The development device as described in claim 5, wherein the second conveyance member constitutes a helical member disposed to be partially in contact with an upper surface of the developer in the first area of the internal space, into which the replenished toner is poured.

8. The development device according to claim 5, wherein the first area of the internal space is configured such that when filled with developer, the developer substantially buries the first conveyance member in the first area of the internal space, and the second conveyance member is disposed above the first conveyance member such that an outer edge of a helical fin of the second conveyance member passes through a surface level of the developer burying the first conveyance member to convey the developer in the opposite direction to the first conveyance direction.

9. A development device, comprising:

a conveyance path for charging and conveying a developer that includes toner and carrier, the conveyance path including an internal space divided by a dividing wall into at least a first area and a second area; and a developer carrying member, wherein the first area of the internal space is undivided and includes:

a first conveyance member for receiving replenished toner and generating conveyance force for conveying the replenished toner and the developer in a first conveyance direction, and a second conveyance member for generating conveyance force for conveying a portion of the developer conveyed by the first conveyance member in an opposite direction to the first conveyance direction of the first conveyance member, and wherein the developer carrying member is configured to develop an electrostatic latent image formed on an electrostatic latent image carrying member into a toner image using the developer conveyed through the conveyance path.

10. The development device as described in claim 9, wherein the second area of the internal space includes a third conveyance member facing the developer carrying member to convey the developer to the developer carrying member which conveys the toner to the electrostatic latent image carrying member, and wherein the conveyance force of the first conveyance member is greater than the conveyance force of the third conveyance member, and the conveyance force of the third conveyance member is greater than the conveyance force of the second conveyance member.

11. The development device as described in claim 10, wherein each of the first conveyance member and the second conveyance member includes a helical member of substantially the same shape, and wherein the conveyance force of the first conveyance member and the conveyance force of the second conveyance member are controlled by varying a rotational speed of the first conveyance member and a rotational speed of the second conveyance member.

12. The development device as described in claim 10, wherein each of the first and second conveyance members includes a first helical member, and wherein the second conveyance member includes a second helical member that is smaller in diameter than the first helical member to control the conveyance force of the first conveyance member and the conveyance force of the second conveyance member.

13. The development device as described in claim 9, wherein the second conveyance member constitutes a helical member disposed to be partially in contact with an upper surface of the developer in the first area of the internal space, into which the replenished toner is poured.

14. The development device as described in claim 9, wherein the replenished toner is poured into the conveyance path and is mixed in with the developer moved in opposite directions by the first conveyance member and the second conveyance member.

15. The development device as described in claim 9, wherein each of the first conveyance member and the second conveyance member include a first helical member and a second helical member, respectively, and wherein the second conveyance member is disposed coaxially with the first conveyance member such that the second helical member is surrounded by a helical portion of the first helical member of the first conveyance member.

16. The development device as described in claim 9, wherein the carrier as well as the toner is replenished.

17. The development device according to claim 9, wherein the first area of the internal space is configured such that when filled with developer, the developer substantially buries the first conveyance member in the first area of the internal space, and the second conveyance member is disposed above the first conveyance member such that an outer edge of a helical fin of the second conveyance member passes through a surface level of the developer burying the first conveyance member to convey the developer in the opposite direction to the first conveyance direction.

18. The development device according to claim 9, wherein the first and second conveyance members are configured to convey the developer within the first area of the internal space concurrently.

19. The development device according to claim 9, wherein the first arid second conveyance members are substantially parallel to each other.

20. The development device according to claim 9, wherein the dividing wall includes circulation openings through which developer passes between at least the first area and the second area of the internal space.

* * * * *